US005581828A

United States Patent [19]

Price

[11] Patent Number: 5,581,828

[45] Date of Patent: Dec. 10, 1996

[54] AIR FLOTATION INSERT FOR WOODEN WATERBED FRAME

[75] Inventor: Gerald H. Price, Burlington, Canada

[73] Assignee: Price Manufacturing, Inc., Burlington, Canada

[21] Appl. No.: 308,121

[22] Filed: Sep. 19, 1994

[51] Int. Cl.[6] ..... A47C 27/08

[52] U.S. Cl. ..... 5/714; 5/924; 5/711

[58] Field of Search ..... 5/453, 455, 449, 5/451, 456, 400, 924, 457, 458

[56] References Cited

U.S. PATENT DOCUMENTS

| | | | |
|---|---|---|---|
| D. 289,572 | 4/1987 | Wanat | D30/33 |
| D. 300,194 | 3/1989 | Walker | D6/604 |
| D. 313,973 | 1/1991 | Walker | D13/168 |
| 1,282,980 | 10/1918 | Takach . | |
| 1,730,752 | 10/1929 | Withers . | |
| 2,000,873 | 5/1935 | Arens . | |
| 2,236,587 | 4/1941 | Williams . | |
| 2,237,012 | 4/1941 | Sampson . | |
| 2,415,150 | 2/1947 | Stein . | |
| 2,542,781 | 2/1951 | Sawyer . | |
| 2,549,597 | 4/1951 | Harris et al. . | |
| 2,604,641 | 7/1952 | Reed . | |
| 2,614,272 | 10/1952 | Morner . | |
| 2,741,780 | 4/1956 | Kimbrig . | |
| 2,919,747 | 1/1960 | Post . | |
| 3,128,480 | 4/1964 | Lineback . | |
| 3,303,518 | 2/1967 | Ingram . | |
| 3,395,604 | 2/1976 | Collins . | |
| 3,705,429 | 12/1972 | Nail . | |
| 3,780,388 | 12/1973 | Thomas et al. | 297/DIG. 3 |
| 3,790,975 | 2/1974 | Philipp et al. . | |
| 3,867,732 | 2/1975 | Morrell | 297/DIG. 3 |
| 4,077,074 | 3/1978 | Fogel . | |
| 4,078,842 | 3/1978 | Zur . | |
| 4,129,145 | 12/1978 | Wynn . | |
| 4,149,285 | 4/1979 | Stanton . | |
| 4,167,049 | 9/1979 | Fogel | 5/402 |
| 4,169,296 | 10/1979 | Darling | 5/453 |
| 4,175,297 | 11/1979 | Robbins et al. | 5/284 |
| 4,224,706 | 9/1980 | Young et al. | 5/449 |
| 4,225,989 | 10/1980 | Corbett et al. | 5/453 |
| 4,305,425 | 12/1981 | Mackal | 137/541 |
| 4,306,322 | 12/1981 | Young et al. | 5/455 |
| 4,371,999 | 2/1983 | Reid | 5/449 |
| 4,394,784 | 7/1983 | Swenson et al. | 5/453 |
| 4,435,864 | 3/1984 | Callaway | 5/400 |
| 4,489,297 | 12/1984 | Haydon | 335/207 |
| 4,521,928 | 6/1985 | Stephenson | 5/400 |
| 4,541,135 | 9/1985 | Karpov | 5/455 |
| 4,631,767 | 12/1986 | Carr et al. | 5/453 |
| 4,644,597 | 2/1987 | Walker | 5/453 |
| 4,682,378 | 7/1987 | Savenije | 5/241 |
| 4,766,628 | 8/1988 | Walker | 5/449 |
| 4,788,729 | 12/1988 | Walker | 5/449 |
| 4,803,744 | 2/1989 | Peck et al. | 5/453 |

(List continued on next page.)

OTHER PUBLICATIONS

Airmaster® Bed Brochure, 1981.

Air Pedic® Bed Brochures, 1985, Available from Price Mattress Manufacturing; 4350 Mainway Dr., Burlington Ontario, L7L 5R7.

*Primary Examiner*—Alexander Grosz

*Attorney, Agent, or Firm*—Howard J. Greenwald

[57] ABSTRACT

An airbed mattress assembly comprised of an air core disposed within a mattress cover, a layer of impact absorbing material with a thickness of from 0.5 to 1.5 inches contiguous with the bottom surface of the air core, an air blower having an intake to atmospheric air and having an exhaust to atmospheric air and having a pressurized air outlet, an air line connected to the pressurized air outlet and connected to the air core, an air valve, means for actuating the first air valve for opening air flow through said first air line and for simultaneously energizing the air blower, and means for actuating the air valve for opening air flow through the air line without simultaneously energizing the air blower. The air core has a depth from about 8 to about 12 inches, a length of from about 80 to about 84 inches and is formed from vulcanizing a multiplicity of sections of calendared material which comprises elastomeric material bonded to a fabric material.

4 Claims, 8 Drawing Sheets

U.S. PATENT DOCUMENTS

| | | | |
|---|---|---|---|
| 4,829,612 | 5/1989 | Adams | 5/81.1 |
| 4,890,344 | 1/1990 | Walker | 297/DIG. 3 |
| 4,897,890 | 2/1990 | Walker | 5/453 |
| 4,908,895 | 3/1990 | Walker | 5/457 |
| 4,986,738 | 1/1991 | Kawasaki et al. | 417/304 |
| 4,991,244 | 2/1991 | Walker | 5/400 |
| 4,998,939 | 3/1991 | Potthast et al. | 5/424 |
| 5,062,169 | 11/1991 | Kennedy et al. | 5/449 |
| 5,072,469 | 12/1991 | Boyd | 5/455 |
| 5,105,488 | 4/1992 | Hutchinson et al. | 5/814 |
| 5,115,526 | 5/1992 | Boyd | 5/917 |
| 5,144,706 | 9/1992 | Walker | 5/400 |
| 5,231,715 | 8/1993 | Strobel | 5/400 |
| 5,231,716 | 8/1993 | Johenning | 5/400 |
| 5,267,362 | 12/1993 | Johenning et al. | 5/400 |
| 5,291,624 | 3/1994 | Strobel | 5/400 |
| 5,309,585 | 5/1994 | Hochschild | 5/918 |

AIR FLOTATION INSERT FOR WOODEN WATERBED FRAME

FIELD OF THE INVENTION

A flotation insert for a wooden waterbed frame comprising an air core disposed within a quilted mattress cover, and an air blower connected to the air core.

BACKGROUND OF THE INVENTION

Waterbeds have been commercially available for at least twenty-five years. In past years they enjoyed a fair amount of commercial success; however, they have always been substantially less than ideal as a sleep product.

Waterbed mattresses, when filled, are relatively heavy and, thus, cannot be used in some older buildings with weaker flooring. Furthermore, waterbed mattresses are characterized by excessive wave motion which often is not attractive to an aging population and is not conducive to restful sleep. Additionally, the water in the waterbed mattresses must be heated and, when more than one person is sleeping on such a mattress, disputes often arise as to the degree of heating which is to be used. Furthermore, unless the water in the waterbed mattresses is periodically treated with chemicals which often are toxic, mold, fungi, and other undesirable organisms proliferate within the waterbed.

It has long been recognized that waterbeds need to be improved; waterbed sales have been significantly decreasing for at least the past five years. Thus, for example, in Canada waterbeds represented about 15 percent of all the bedding products sold in 1989; in 1994, however, waterbeds represent only about 2 percent of the bedding products sold in Canada.

There have been several attempts to improve waterbeds which involve the substitution in part of an airbed mattress for a waterbed mattress. These attempts have met with less than resounding success.

One such attempt, which never achieved commercial success, is described in U.S. Pat. Nos. 5,115,526 and 5,072,469 of Boyd. In these patents, Boyd disclosed that, with the standard waterbed mattress, ". . . it sometimes became difficult for the user's skin to breath." Referring to U.S. Pat. No. 5,072,469, the solution provided by Boyd was ". . . an inflatable air cushion 23 disposed on top 15 of bladder 13 . . . " (see column 2). The air cushion is formed from vinyl (see, e.g., column 2 and claim 2).

Another attempt to combine air mattress technology with waterbed technology is a waterbed insert which has been sold since 1987 and is manufactured by the Price Mattress Manufacturing Company of Burlington, Ontario. This insert is comprised of an air mattress disposed within a foam perimeter, both of which are encased within a quilted mattress cover. The mattress cover assembly rests upon a four-inch layer of polyurethane foam disposed between the mattress cover and the waterbed frame pedestal. Although this product has met with moderate success, it presents several problems. In the first place, the polyurethane foam often develops soft spots due to wear, which then provides uneven support for the mattress assembly. Furthermore, the polyurethane foam is prone to become damaged when the mattress is moved. Additionally, the use of the foam perimeter assembly substantially reduces the effective sleeping area.

In an attempt to avoid the problems of such hybrid assemblies, several companies have attempted to entirely replace the waterbed mattress within the waterbed assembly with an air mattress.

In about 1981, Air Beds Inc. (formerly of 2082 Zanker Road, San Jose, Calif.) came out with a line of "Airmaster" beds, which contained a vinyl air mattress disposed within a quilted mattress cover, the entire assembly resting within a wooden waterbed frame. At least three separate vinyl air cores were used by Air Beds Inc. in their products, to no avail. Air Beds Inc. went bankrupt in 1986 after their product met with a substantial amount of customer disapproval; it is reported that their return rate (i.e., the percentage of purchasers who returned the product after the sale) was about 80 percent.

In 1985, Price Manufacturing Inc. also tried manufacturing and selling a waterbed insert assembly comprising a vinyl air core disposed within foam perimeter, the entire assembly being disposed within a quilted mattress cover. The air core used in this product was made from waterbed vinyl and fabricated according to the waterbed mattress manufacturing techniques which were conventional in 1985 (and, to the best of applicant's knowledge, still are). The waterbed insert assembly was sold as the "Price Airpedic Air Bed". In spite of extensive efforts to produce a first quality product, the return rate for this product was about 73 percent.

It is common knowledge in the bedding industry that many efforts have been made to replace a waterbed mattress with a viny air mattress, but that all of such efforts have resulted in products with return rates significantly exceeding industry standards.

It is also common knowledge within the bedding industry that at least one-hundred thousand spring mattresses are sold each year in the United States to replace waterbed bladders within wooden waterbed frames. However, most people accustomed to the feel of a waterbed mattress are not satisfied replacing it with the firmer feel of a spring mattress.

It is an object of this invention to provide an air mattress assembly comprised of an air core which can be used by customers to replace waterbed bladders within wooden waterbed frames, which assembly will provide the molding effect and support of the waterbed bladder without its concomitant weight and motion problems.

It is another object of this invention to provide an air mattress assembly comprised of an air core which can be used by customers to replace waterbed bladders within wooden waterbed frames which assembly will meet with a degree of customer acceptance substantially higher than that obtained with prior waterbed insert products.

It is yet another object of this invention to provide an air mattress assembly comprised of an air core which can be used by customers to replace waterbed bladders within wooden waterbed frames, which assembly comprises an air blower and means for introducing or removing air from the air core.

It is an object of this invention to provide an air mattress assembly comprised of an air core which can be used by customers to replace waterbed bladders within wooden waterbed frames, which assembly is comprised of a blower which can readily inflate such air core but can do so without generating a substantial amount of noise.

It is an object of this invention to provide an air mattress assembly comprised of an air core which can be used by customers to replace waterbed bladders within wooden waterbed frames, which assembly provides a larger effective sleeping surface than prior waterbed air-mattress insert products.

It is an object of this invention to provide an air mattress assembly comprised of an air core which can be used by customers to replace waterbed bladders within wooden waterbed frames, which assembly, once inflated, will retain its sleep properties for a substantially longer period of time than prior art products.

It is an object of this invention to provide an air mattress assembly comprised of two air cores which can be used by customers to replace waterbed bladders within wooden waterbed frames.

SUMMARY OF THE INVENTION

In accordance with this invention, there is provided an air mattress assembly adapted to fit within a wooden waterbed frame. This assembly contains an air mattress disposed within a mattress cover and containing an air core connected to an air blower.

DESCRIPTION OF THE PREFERRED EMBODIMENTS

Figure 1:
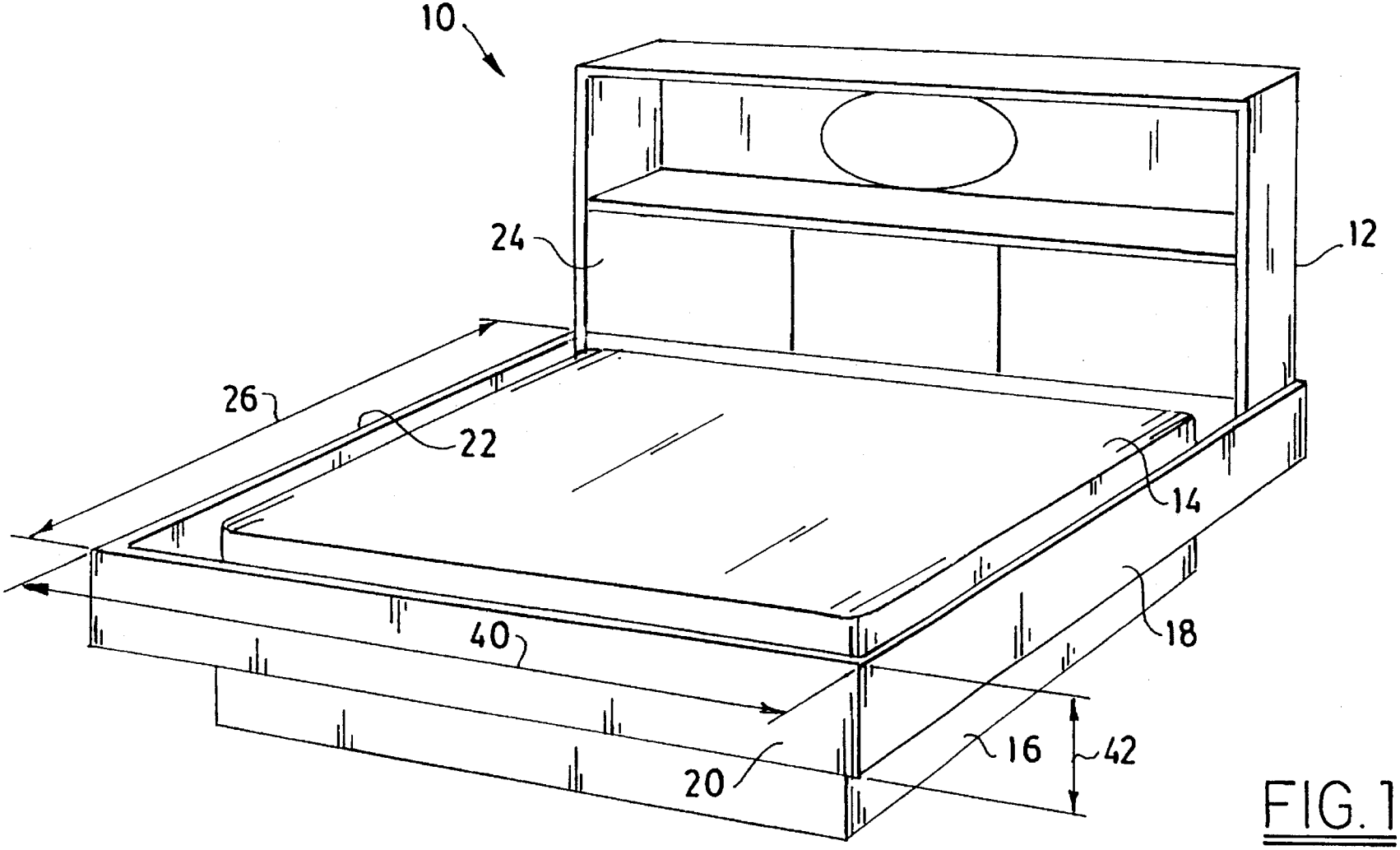
FIG. 1 is a perspective view of a wooden waterbed frame in which an air mattress assembly of this invention is disposed.

FIG. 1 is a perspective view of a waterbed assembly 10 which is comprised of wooden waterbed frame 12 and air mattress insert assembly 14.

Air mattress insert assembly 14 may be used with substantially any waterbed frame. Thus, by way of illustration and not limitation, one may use such assembly 14 with one or more of the waterbed frames disclosed in U.S. Pat. Nos. 5,309,585, 5,291,624 (wooden waterbed frame), 5,267,362, 5,231,716, 5,231,715, 5,191,664, 4,521,928, 4,167,049, 4,077,074, D289,572, and the like. The disclosure of each of these patents is hereby incorporated by reference into this specification.

It is preferred that the waterbed frame 12 consist essentially of wood. One especially preferred wooden waterbed frame is illustrated in FIG. 1.

Referring to FIG. 1, it will be seen that waterbed frame 12 is comprised of a wooden pedestal 16, wooden sides 18, 20, and 22, and wooden headboard 24. In this preferred embodiment, the length 26 of sides 18 and 22 is preferably about 84 inches, and the width 40 of side 20 is from about 48 to 72 inches. The depth 42 of each of sides 18, 20, and 22 is from about 6 to about 12 inches and, preferably, is about 9 inches.

Figure 2:
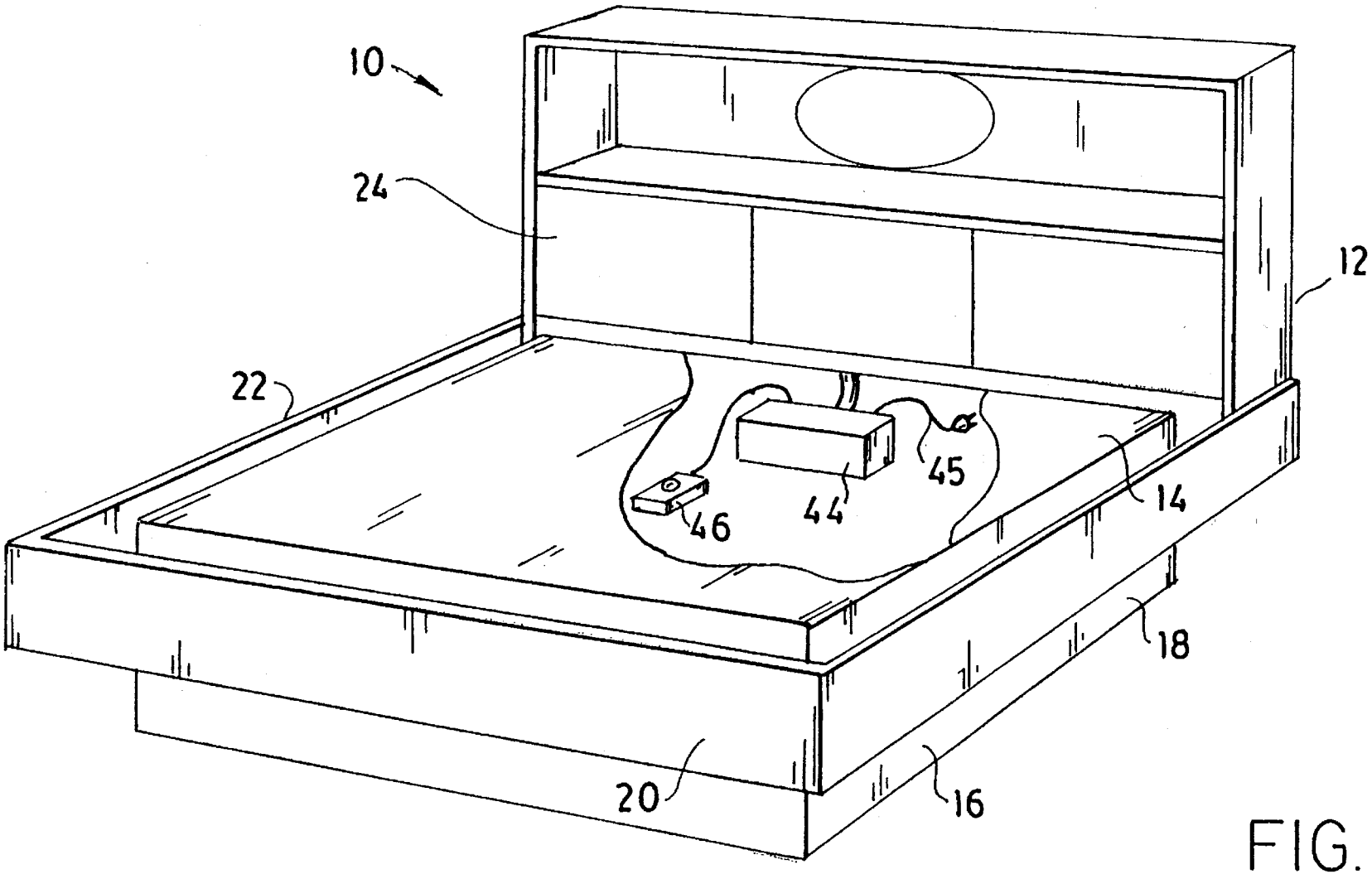
FIG. 2 is a partially broken away perspective view of the wooden waterbed frame assembly of FIG. 1, showing the relationship of the air blower device to said assembly.
Figure 10:
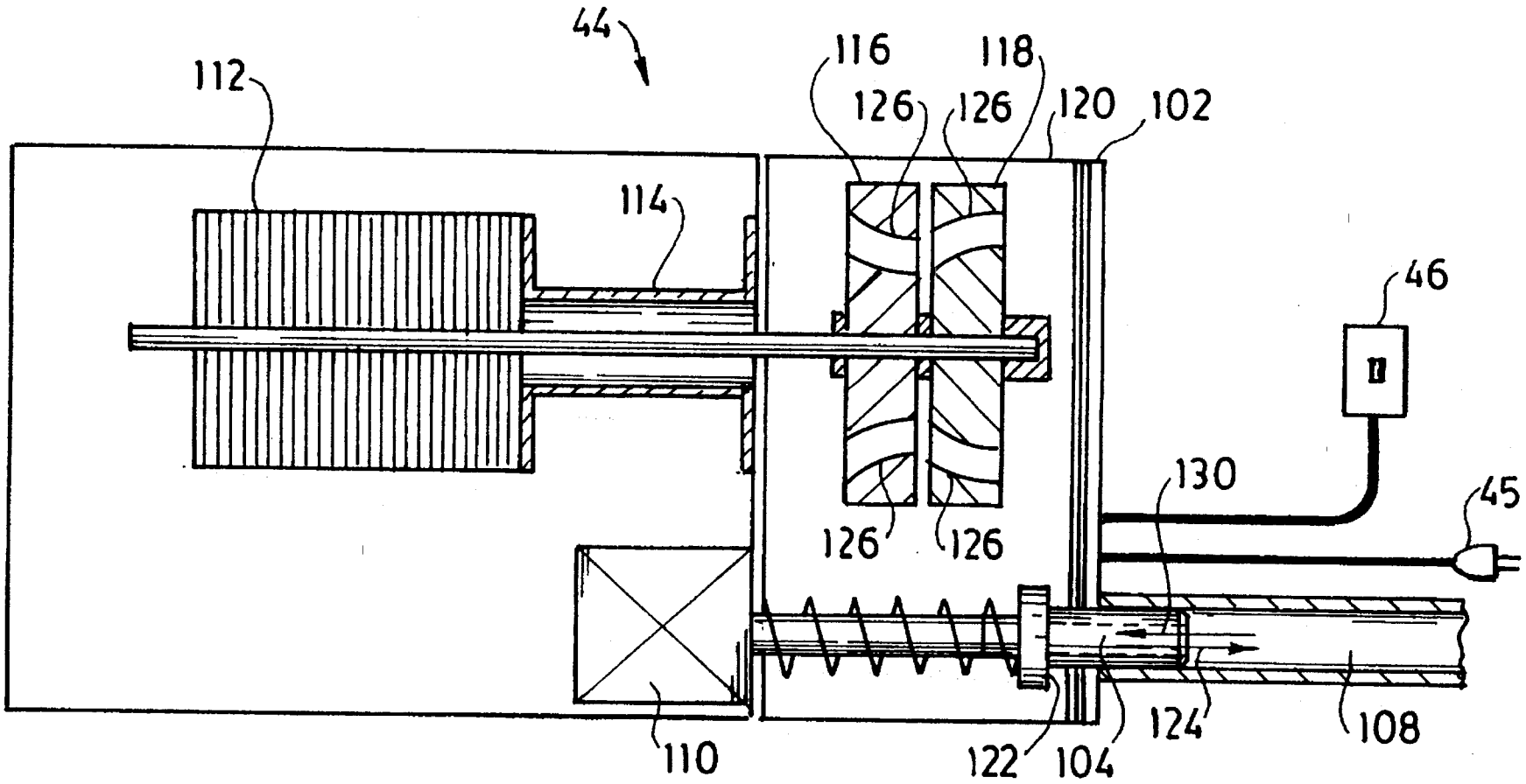
FIG. 10 is a sectional view of one preferred pump which may be used in applicant's insert assembly.

FIG. 2 is a perspective view of the waterbed assembly 10 of FIG. 10 which is partially broken away to show the connection of the pump 44 and the controller 46. As will be seen by reference to FIG. 2, and in the preferred embodiment illustrated therein, pump 44 is underneath waterbed frame 12 (and is in pedestal 16 in this embodiment), mattress 14 is disposed on top of pedestal 16, and controller 46 may be disposed on top of mattress 14.

Air mattress 14, subject to the limitations described elsewhere in this specification, may have substantially any configuration of the air mattresses disclosed in the prior art. Thus, as long as the "prior art" air mattress configuration is made with the specified material, has the specified density, and, in one embodiment, has the specified number of air bladders, it may be used in applicant's system.

In one especially preferred embodiment, the insert assembly may be used in conjunction with the air mattress disclosed and claimed in U.S. Pat. No. 4,394,784 of Gerald R. Swenson et al.; the entire disclosure of this patent is hereby incorporated by reference into this specification.

U.S. Pat. No. 4,394,784 discloses, and claims: "An air bed system having firmness control of an air bladder confined within a mattress, comprising (a) an air blower having an intake to atmospheric air and having an exhaust to atmospheric air, and having a pressurized air outlet; (b) an air line connected to said pressurized air outlet and connected to said air bladder; (c) an air valve for selectively openings and closing air flow therethrough; (d) means for actuating said air valve for opening flow through said air line and for energizing said air blower; and (e) means for actuating said air valve for opening air flow through said air line and for deenegizing said air blower (see claim 1).

In other embodiments, one or more of the air beds disclosed in the patents cited during the prosecution of U.S. Pat. No. 4,394,784 may be used in conjunction with applicant's insert assembly. Thus, by way of further illustration but not limitation, one may use one or more of the air beds disclosed in U.S. Pat. Nos. 3,303,518 of Ingram, 4,078,842 of Zur, 4,224,706 of Young et al., 4,306,322 of Young et al. and/or in German patent 1529538 may be used in applicant's claimed apparatus. The disclosure of each of these patents is hereby incorporated by reference into this specification.

In another preferred embodiment, the insert assembly is used in conjunction with the air mattress assembly described in U.S. Pat. No. 4,908,895; the entire disclosure of such patent is hereby incorporated by reference into this specification.

U.S. Pat. No. 4,908,895 describes an air mattress which contains a chamber and, located with such chamber, a ". . . plurality of transverse webs . . . ." In particular, this patent discloses and claims "An air mattress accommodating air under pressure for providing support for a body comprising: a top wall, a bottom wall spaced from and located below the top wall, side walls and end walls secured to said top and bottom walls, all of said walls comprising flexible air impervious sheet members sealed together along the edge portions thereof to form a chamber for accommodating air under pressure, seam means securing adjacent portions of the sheet members together, a pair of longitudinal first support means located in said chamber extended between said end walls adjacent the side walls and secured to said top and bottom walls providing longitudinal passages accommodating air, a plurality of transverse second support means located in said chamber extended between said pair of first support means and secured to said top and bottom walls providing transverse passages for accommodating air, said first and second support means limiting outward expansion of the top and bottom walls when air under pressure is stored in said chamber; each of said first and second support means having a continuous web section and opposite end portions, an opening adjacent each of said end portions allowing air communication between said transverse and longitudinal passages, the opposite end portions of said first support means longitudinally spaced from said end walls, and the opposite end portions of said second support means laterally spaced from the web sections of the first support means to provide said openings, first tube means mounted in the seam means in one end of the air mattress to facilitate supplying air under pressure to said chamber, an elongated flexible and elastic tube connected to the first tube means and adapted to be connected to a supply of air under pressure to said chamber and retain air under pressure within said tube, and said second tube means mounted in the seam mean s in a second end of the air mattress, and air pressure relief valve means connected to said second tube means in communication with said chamber and atmosphere whereby air is vented from said chamber through said valve means when the pressure of the air within the chamber exceeds a selected maximum limit."

In other preferred embodiments, one or more of the airbeds disclosed in the patents cited during the prosecution of U.S. Pat. No. 4,908,895 may be used in conjunction with applicant's insert assembly. Thus, by way of further illustration but not limitation, one may use one or more of the airbeds disclosed in U.S. Pat. Des. No. 300,194 of Walker, U.S. Pat. Des. No. 486,696 of Curlin, U.S. Pat. No. 1,282,980 of Takach, U.S. Pat. No. 1,730,752 of Withers, U.S. Pat. No. 2,000,873 of Arens, U.S. Pat. No. 2,236,587 of Williams, U.S. Pat. No. 2,237,012 of Sampson, U.S. Pat. No. 2,415,150 of Stein, U.S. Pat. No. 2,542,781 of Sawyer, U.S. Pat. No. 2,549,597 of Harris et al., U.S. Pat. No. 2,604,641 of Morner, U.S. Pat. No. 2,614,272 of Morner, U.S. Pat. No. 2,741,780 of Kimbrig, U.S. Pat. No. 2,919,747 of Post, U.S. Pat. No. 3,128,480 of Lineback, U.S. Pat. No. 3,705,429 of Nail, U.S. Pat. No. 3,780,388 of Thomas et al., U.S. Pat. No. 3,790,975 of Phillip et al., U.S. Pat. No. 3,867,732 of Morrell, U.S. Pat. No. 4,225,989 of Corbett et al., U.S. Pat. No. 4,306,322 of Young et al., U.S. Pat. No. 4,394,784 of Swenson et al., U.S. Pat. No. 4,541,135 of Karpov, U.S. Pat. No. 4,631,767 of Carr et al., U.S. Pat. No. 4,644,597 of Walker, and U.S. Pat. No. 4,682,378 of Savenije. The entire disclosure of each of these United States patents is hereby incorporated by reference into this specification.

In yet another preferred embodiment, applicant's insert assembly may be used in conjunction with the air bed assemblies disclosed in one or more of U.S. Pat. Nos. 5,170,522, 4,897,890 4,644,597, 5,144,706, 4,890,344, 4,788,729, 4,991,244, 4,829,612, 4,766,628, U.S. Pat. Des. Nos. 300,194, and 313,973. The disclosure of each of these patents is hereby incorporated by reference into this specification.

In yet another preferred embodiment, applicant's insert assembly is used in conjunction with the air bed disclosed in U.S. Pat. No. 5,105,488, the entire disclosure of which is hereby incorporated by reference into this specification.

In yet another embodiment, the hospital air bed disclosed in U.S. Pat. No. 4,803,744 (the entire disclosure of which is hereby incorporated by reference into this specification) may be used in conjunction with applicant's insert assembly.

In yet another patent, the insert assembly may be used in conjunction with the air bed systems disclosed in U.S. Pat. Nos. 4,986,738 and 5,062,169.

The air mattress used in applicant's insert system is comprised of at least one (and preferably at least two) air cores. Any of the air cores known to those skilled in the art may be used. Thus, by way of illustration and not limitation, and referring to U.S. Pat. No. 4,908,895 (see column 2), "A plurality of transverse sheet beams or webs are secured to the top and bottom walls to maintain the air mattress in a box-like shape. A pair of longitudinal sheet beams or webs are secured to the top and bottom walls between the outer ends of the transverse webs and the side walls of the air mattress. The longitudinal and transverse webs stabilize side to side mattress sway motion and eliminate uneven areas on the top wall of the air mattress. The opposite ends of the transverse and longitudinal webs have openings to allow air to flow into and out of the transverse and longitudinal air chambers. The walls and webs can be nylon fabric and vinyl plastic or cotton fabric and rubber sheet materials sealed together. These sheet materials are air impervious and form seals that do not tear or rip apart in use.

As will be apparent to those skilled in the art, the air cores used may be similar to the air mattress 20 described in U.S. Pat. No. 4,908,895 with the exception that the latter air mattress contains transverse webs whereas the former air mattresses do not.

By way of further illustration and not limitation, one may use one or more of the air cores described in U.S. Pat. Des. No. 300,194, U.S. Pat. Nos. 4,788,729, 4,644,597, 4,371,999, 4,986,738, 5,062,169, 4,788,729, 4,394,784, 4,305,425, 4,225,989, 4,224,706, 4,175,297, 4,169,295, 4,149,285, 4,129,145, and the like. The disclosure of each of these patents is hereby incorporated by reference into this specification.

Air bedding systems comprising such air cores are commercially available and may be purchased from, Dynatech, Inc. of Greenville, S.C. as the "Comfortaire Air Bed."

Figure 3:
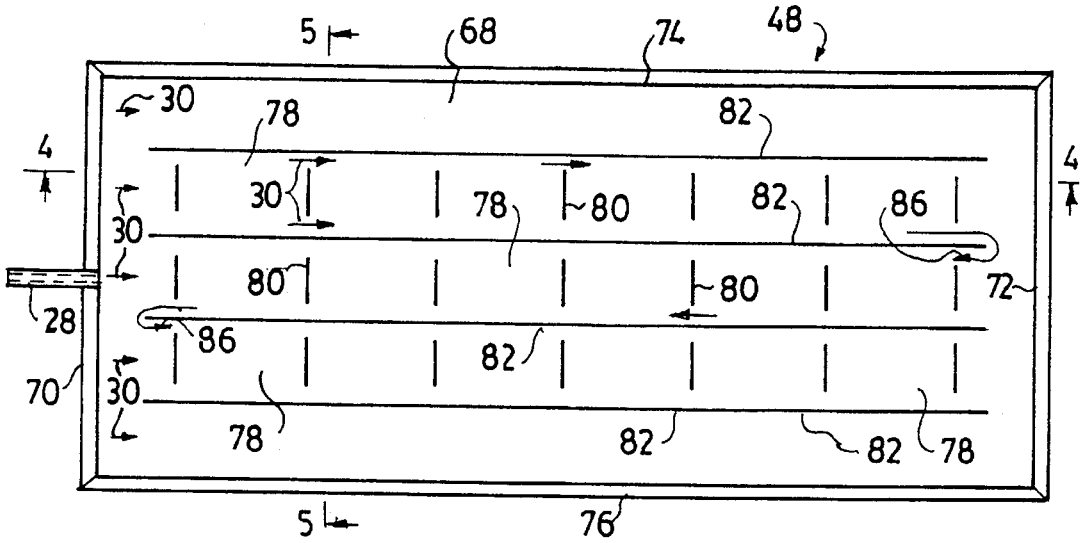
FIG. 3 is a top view of one preferred embodiment of the air mattress used in the insert system of FIG. 1, with the baffle design of such mattress indicated by dotted lines.

FIG. 3 is a top view of a preferred air core 48. Referring to FIG. 3, it will be seen that air core 48 is comprised of a multiplicity of fabric 68 which extends from front edge 70 to back edge 72, and from side edge 74 to side edge 76.

Within fabric 68 a multiplicity of air compartments 78 which are formed by baffles 80 and longitudinally-extending beams 82.

Air may flow into (or out of) air hose 28. For the purpose of illustration, the discussion will relate to air inflow, it being obvious that the reverse process can occur in the reverse direction.

Referring again to FIG. 3, air may flow through air hose 28 in the directions of arrows 38.

The transversely-extending baffles 80 do not completely extend from one side of beam 82 to another. Thus, referring to a portion of FIG. 3, it will be seen that air may flow around openings 84 formed between the ends of baffles 80 and the interior walls of beams 82. Additionally, air may flow in the direction of arrows 86 and 88. It will be apparent to those skilled in the art that, because air is free to flow past all of the baffles 80 and into each of the air compartments 78, the air pressure in each of said compartments will be substantially equal once an equilibrium pressure been attained.

Figure 4:
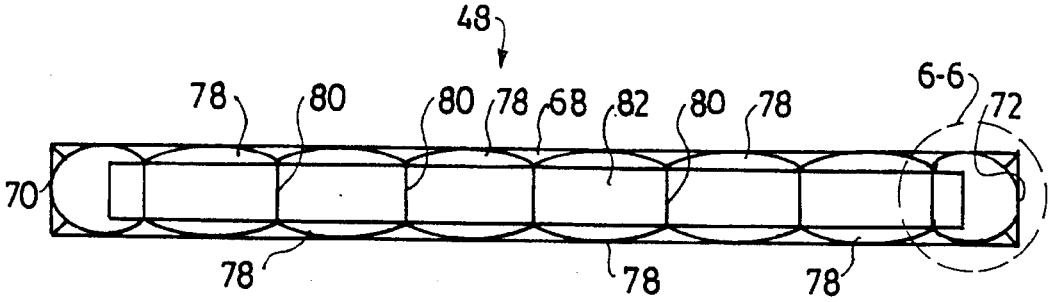
FIG. 4 is a side view of the air mattress of FIG. 3.
Figure 5:
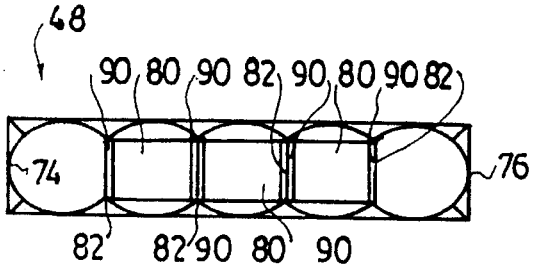
FIG. 5 is an end view of the air mattress of FIG. 3.

FIG. 4 is a longitudinal sectional view of air mattress 48. FIG. 5 is a transverse sectional view of air mattress 48. Referring to FIG. 5, it will be seen that air may flow in the direction of arrows 84, 86, and 88 (see FIG. 3) though openings 90 formed between the ends of baffles 80 and the beams 82.

Figure 6:
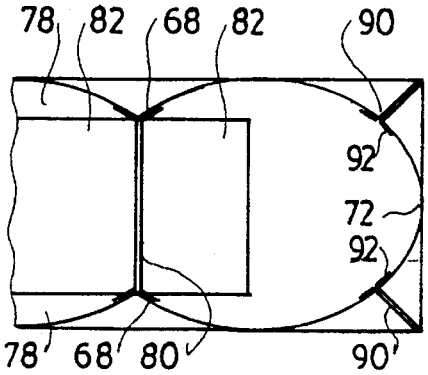
FIG. 6 is an enlarged side view of one portion of the air mattress of FIG. 3.

FIG. 6 is an enlarged sectional view of FIG. 4. Referring to FIG. 6, it will be seen that baffle 80 has a substantially I-shaped structure (and thus is often referred to as an I beam) and is joined to fabric 68 at its top and bottom. Although not specifically illustrated in FIGS. 3 through 6, it is preferred that longitudinally-extending beams 82 also have an I-beam structure and also be joined at their tops and bottoms to fabric 68.

Referring again to FIG. 6, and in the preferred embodiment illustrated, the seams between the sides, the top, and the bottom of fabric 68 and 72 may be joined by conventional means such as, e.g., vulcanized butt seam 90 and lap seam 92.

In one preferred embodiment, all of the seaming used to form the air core 48 is heat-vulcanized, and the fabric 68 is preferably a latex rubber with a fabric outer side to prevent stretching. The fabric outer side may consist, e.g., of cotton, of polyester, of a fabric blend of natural and/or synthetic fiber, a knit fabric, a warp fabric, and/or a nonwoven fabric. In one preferred embodiment, such fabric is knit poly(ethylene terephthalate).

Figure 6A:
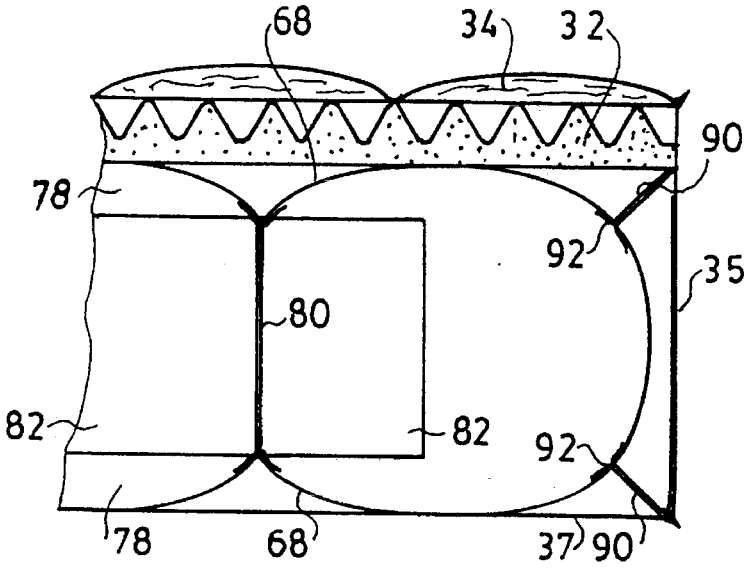
FIG. 6A is an enlarged side view of one preferred embodiment of the air mattress insert assembly.

FIG. 6A is a partial perspective view of cover 34 disposed over convoluted foam layer 32. Referring to FIG. 6, it will be seen that cover 34 is comprised of side 35, bottom 37.

It is preferred that the fabric 68 preferably be an elastomeric material with a fabric outer side to prevent stretching. As is known to those skilled in the art, the elastomeric material may be a natural rubber or a synthetic rubber, or mixtures thereof.

In one embodiment, the elastomer used is rubber with a tensile strength of from about 800 to about 1,200 pounds per square inch.

In one preferred embodiment, the elastomeric material used is a natural rubber with a deformation after break ("permanent set") of from about 5 to about 10 percent. In another embodiment, the elastomeric material is a synthetic rubber with a deformation after break of at least about 50 percent.

In one preferred embodiment, the elastomeric material is a synthetic rubber.

In one preferred embodiment, the elastomeric material is butyl rubber with a tensile strength of from about 2300 to about 3,000 pounds per square inch, and a Shore Hardness of from about 40 to about 70.

In one preferred embodiment, the air core 48 is substantially impermeable. When a weight of 600 pounds is placed upon the air core 48 and allowed to remain there for 120 hours, the preferred assembly 48 will not lose more than ten percent of the air pressure in such assembly at time zero.

Figure 7:
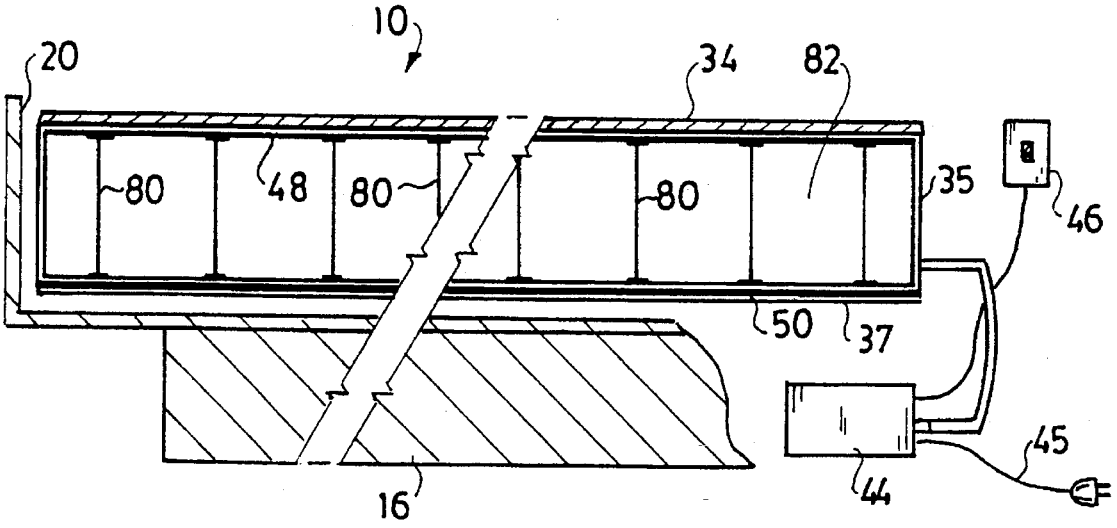
FIG. 7 is partially broken away side sectional view of the air mattress assembly of FIG. 1.

One preferred embodiment of the air mattress insert assembly 14 is illustrated in FIG. 7. Referring to FIG. 7, it will be seen that air core 48 is disposed within mattress cover 34. The mattress cover 34, which preferably is quilted on its tops and side, is disposed over air core 48. The mattress cover 34 may be preferably be closed by conventional means such as, e.g., a zipper, "VELCRO" loop and hook fastening means (not shown), a draw string (not shown), permanent sewing (not shown), and the like.

In the preferred embodiment illustrated in FIG. 7, a layer 50 of impact-asorbing material (such as foam, felt, heavy fabric, polyester fabric, bonded polyester fiber, cardboard, and the like) is disposed between the bottom of air core 48 and the bottom 37 of the mattress cover 34. The layer 50 of impact absorbing material is preferably at least about 0.25 inches thick, more preferably at least about 0.5 inches thick and, even more preferably, has a thickness of from about 0.5 to about 1.5 inches.

As is known to those skilled in the art, foam materials are materials with a spongelike, cellular structure and include, e.g., sponge rubber, plastic foams, latex foams, polyurethane foams, and the like.

It is preferred that the layer 50 be comprised of polyurethane foam. As is known to those skilled in the art, urethane foams are made by adding a compound that produces carbon dioxide or by reaction of a diisocyanate with a compound containing active hydrogen. See, e.g., page 874 of George S. Brady et al.'s "Materials Handbook," Thirteenth Edition (Mc-Graw-Hill, Inc., New York, 1991).

In one preferred embodiment, the polyurethane foam used is a flexible foam with a density of from about 1 pound per cubic foot to about 5 pounds per cubic foot and, preferably, has an independent load deflection (ILD) of from about 20 to about 80.

Figure 8:
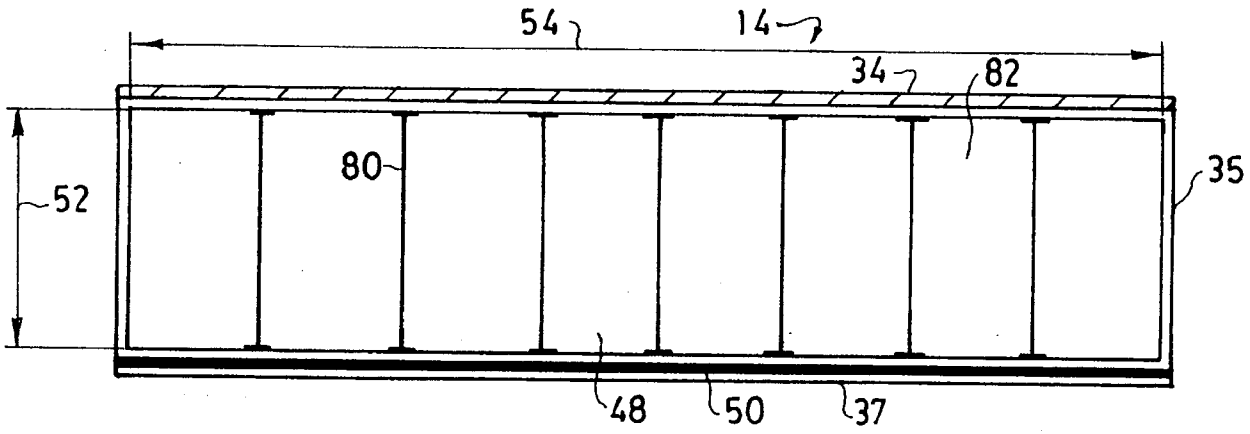
FIG. 8 is a sectional front view of one preferred mattress assembly which may be used in the claimed insert.
Figure 9:
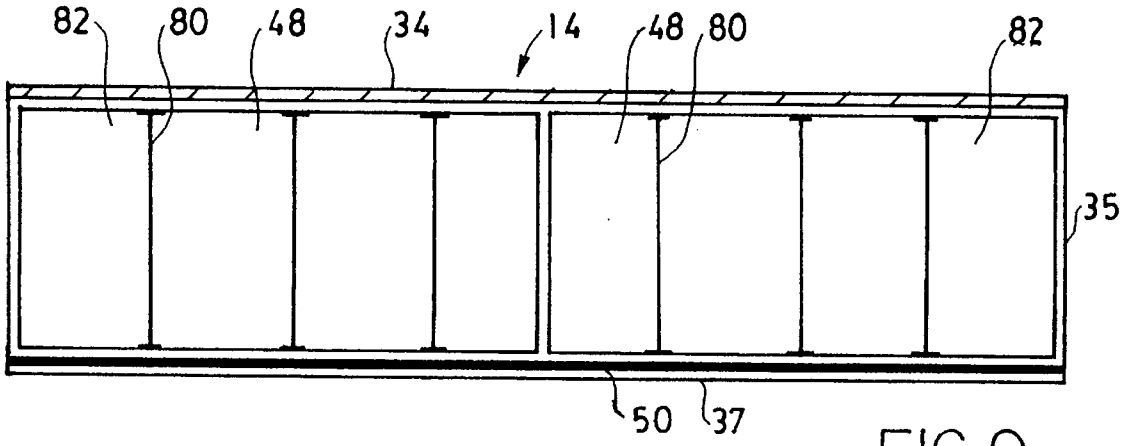
FIG. 9 is a sectional front view of another preferred mattress assembly which may be used in the claimed insert assembly.

FIG. 8 is a front sectional view of one embodiment of the air mattress insert assembly 14, illustrating the presence of one air core 48. FIG. 9, by comparison, is a front sectional view of another embodiment of air mattress insert assembly 14, illustrating the presence of two air cores 48.

Referring to FIG. 8, it will be seen that air core 48, after it is inflated to one pound per square inch above ambient pressure, has a depth 52 of from about 6 to about 12 inches and, preferably, at least 8 inches. The air core 48, after it is inflated to one pound per square inch above ambient pressure, has a width 54 of from about 27 to about 72 inches. The length of air core 48, after it is inflated to one pound per square inch above ambient pressure, has a length (not shown) of from about 80 to about 84 inches.

FIG. 10 is a sectional view of one pump 44 which may be used in the assembly of the instant invention. It is preferred that pump 44 deliver at least about 200 cubic inches of air per second and, more preferably, at least about 275 inches of air per second. Furthermore, during such operation, it is preferred that pump 44 not produce more than a specified amount of noise.

It is also preferred that, when the air flowing from pump 44 operated at a speed of 16,000 revolutions per minute is flowed into beaker of water into which a glass tube with a 0.25 inch inside diameter is disposed within the water, the water will have a "water lift" of at least 17 inches (that is, it will rise at least 17 inches above the level of the water in the beaker). It is preferred that the water lift achieved by pump 44 be at least about 19.5 inches.

When pump 44 operates at 16,000 revolutions per minute, it produces less than 81 decibels of sound when measured with a standard decibel meter located 3.0 feet away from pump 44.

Pump 44 may be similar to the rotary airbed pumps described in the prior art, provided that they produce the required rate of air flow and the required water lift and they do not exceed the specified noise level.

Thus, by way of illustration and not limitation, one may use an air pump similar to that disclosed in U.S. Pat. Nos. 4,890,344 of Walker, 4,897,890 of Walker, 4,986,734 of Kawasaki, 4,394,784 of Swenson, and the like. The disclosure of each of these United States patents is hereby incorporated by reference into this specification.

Referring again to FIGS. 10 and 11, it will be seen that pump 44 is comprised of removable face plate 102 comprising air stem 104 and air stem 106 (not shown in FIG. 10). Air hose 108 is removably connected to air stem 104; a comparable air hose (not shown) is removably connected to air stem 106 (not shown).

An electrical plug 45 is electrically connected to pump 44. Hand-held controller 46 is also electrically connected to pump 44 and directs such pump to either pump air into allow air to flow from the air mattress 48. A comparable controller 47 (not shown in FIGS. 10 and 11) also may be used (see FIG. 12).

Figure 11:
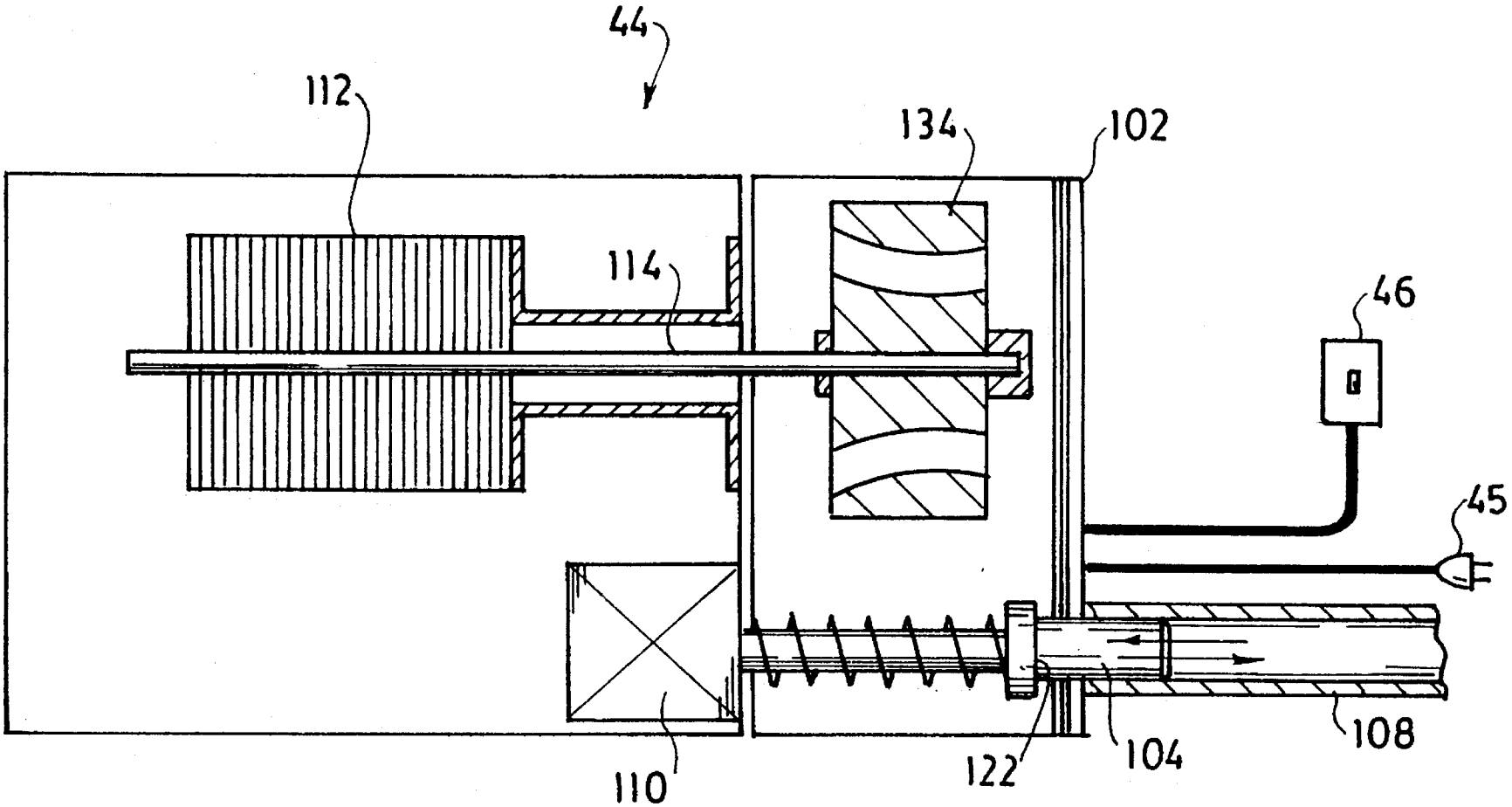
FIG. 11 is a sectional view of another preferred pump which may be used in applicant's insert assembly.

FIG. 10 illustrates a pump assembly 44 with two oppositely-facing impellers 116 and 118. By comparison, FIG. 11 illustrates a pump assembly 44 with only one impeller 134 which, because of its increased size, has substantially the same air output and noise production properties.

Referring to again to FIGS. 10 and 11, it will be seen that pump 44 is comprised of a solenoid operated air valve 110 which is activated by controller 46. Another solenoid operated air valve (not shown) is operatively connected to controller 47.

Referring to FIG. 10, when controller 46 is set to the "firm" setting, it causes solenoid valve 110 to open and motor 112 to rotate shaft 114 and cause impeller 116 and impeller 118 to rotate, thereby causing air turbulence in impeller chamber 120. Air then may escape through seating 122 in the direction of arrow 124.

Referring again to FIG. 10, and in the preferred embodiment illustrated therein, it will be seen that each of impeller 116 and impeller 118 is comprised of vanes 126 disposed in different directions.

When, by comparison, the signal from controller 46 is "soft," the solenoid 110 is activated without activating the motor 112. In this situation, air is allowed to escape from air core 48, through hose 108, and out past seating 122 in the direction of arrow 130.

Figure 12:
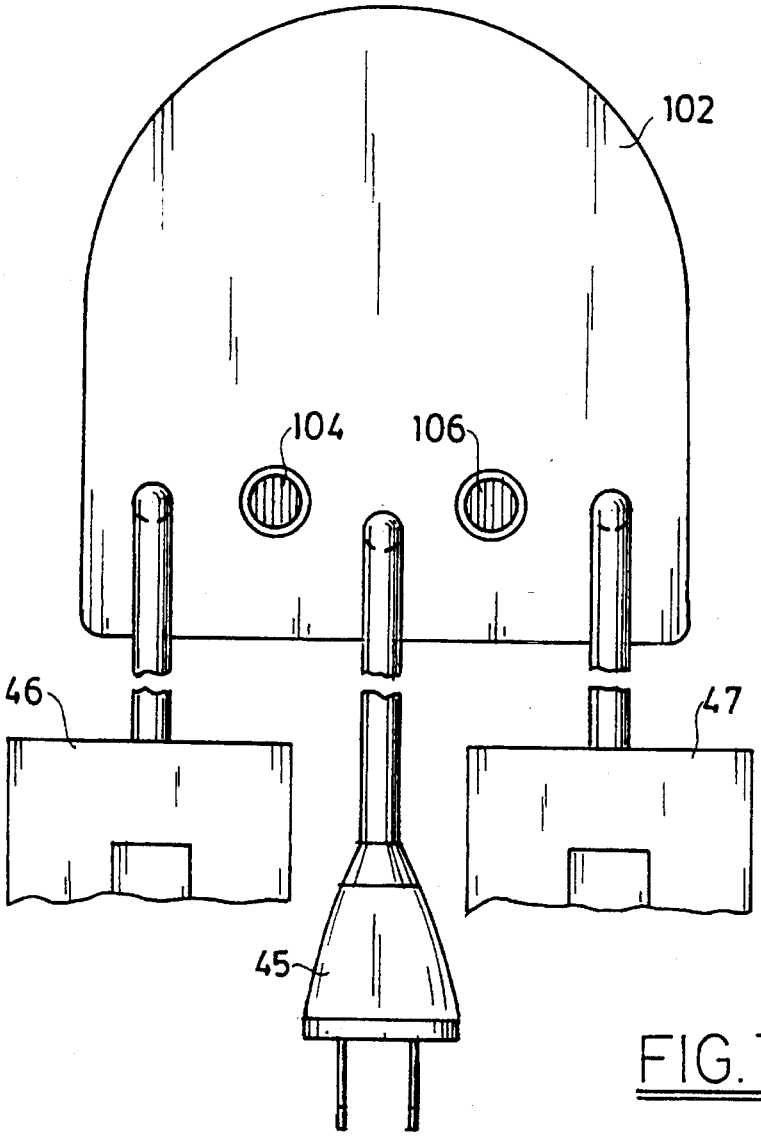
FIG. 12 is a front view of the pump assembly of FIG. 10.

FIG. 12 is a front view of face plate 102 showing its connection to hand-controllers 46 and 47, powder cord 45, and the air hoses (not shown) via valve stems 104 and 106.

Figure 13:
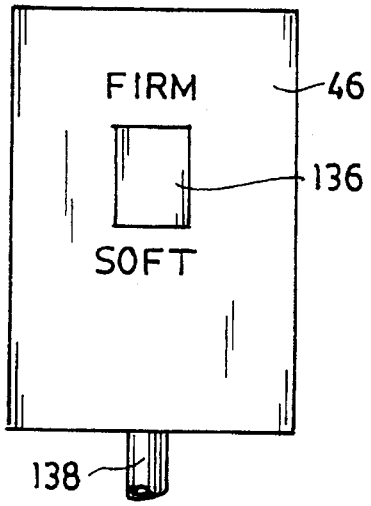
FIG. 13 is a top view of one hand controller which may be used together with the pump assembly of FIG. 10.

FIG. 13 is a top view of controller 46. Referring to FIG. 13, it will be seen that controller 46 is comprised of a switch 136 which, when depressed or otherwise activated, sends a signal (not shown) through electrical wire 138 to pump 44 (not shown).

It will be appreciated by those skilled in the art that other control units may also be used which are capable of causing air to either flow into or out of air core(s) 48. Thus, by way of illustration and not limitation, one may use the control units described in U.S. Pat. Nos. 4,394,784, 4,435,864, 4,489,297, 3,935,604, 4,998,939, 4,644,597, and U.S. Pat. Des. No. 313,973; the disclosure of each of these patents is hereby incorporated by reference into this specification.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. An airbed mattress assembly comprised of an air core disposed within a mattress cover, wherein said air core is comprised of a top surface and a bottom surface, a layer of impact absorbing material contiguous with said bottom surface of said air core with a thickness of from about 0.5 to about 1.5 inches, means for inflating said air core having an intake to atmospheric air and having an exhaust to atmospheric air and having a pressurized air outlet, an air line connected to said pressurized air outlet and connected to said air core, an air valve, means for actuating said air valve for opening air flow through said air line and for simultaneously energizing said means for inflating said air core, and means for actuating said air valve for opening air flow through said air line without simultaneously energizing said means for inflating said air core, wherein:

(a) said mattress cover encloses said air core and is contiguous with said top surface of said air core and said layer of impact absorbing material;

(b) said air core, when inflated to a pressure of one pound per square inch above ambient pressure, has a depth of from about 8 to about 12 inches and a length of from about 80 to about 84 inches;

(c) said air core consists essentially of a calendered fabric material comprised of elastomeric material bonded to fabric material, wherein said elastomeric material is selected from the group consisting of natural rubber, synthetic rubber, and mixtures thereof, and wherein said air core is formed by vulcanizing a multiplicity of sections of said fabric material; and (e) said air core, when inflated to an air pressure of one pound above ambient pressure and when subjected to a weight of 600 pounds for 120 hours, loses less than about ten percent of the air pressure initially present in said air core.

2. The airbed mattress assembly as recited in claim 1, wherein said layer of impact absorbing material consists essentially of foam material.

3. The airbed mattress assembly as recited in claim 3, wherein a layer of foam material is disposed between said top surface of said air core and said mattress cover.

4. The airbed mattress assembly as recited in claim 1, wherein said layer of impact absorbing material consists essentially of cardboard material.

* * * * *